US007717813B2

(12) United States Patent
Sinovich

(10) Patent No.: US 7,717,813 B2
(45) Date of Patent: May 18, 2010

(54) BASES FOR BASEBALL AND SOFTBALL

(76) Inventor: Marc F. Sinovich, 53 Grand Circle Dr., Maryland Heights, MO (US) 63043

( * ) Notice: Subject to any disclaimer, the term of this patent is extended or adjusted under 35 U.S.C. 154(b) by 0 days.

(21) Appl. No.: 11/557,558

(22) Filed: Nov. 8, 2006

(65) Prior Publication Data

US 2008/0108460 A1 May 8, 2008

(51) Int. Cl.
*A63B 71/00* (2006.01)
*A63B 69/00* (2006.01)

(52) U.S. Cl. ..... 473/499; 473/452

(58) Field of Classification Search ..... 473/497, 473/499, 500, 501
See application file for complete search history.

(56) References Cited

U.S. PATENT DOCUMENTS

| | | | | | |
|---|---|---|---|---|---|
| 3,181,863 | A | * | 5/1965 | Nellermoe | 473/499 |
| 3,836,146 | A | * | 9/1974 | Gotomb | 473/499 |
| 3,862,756 | A | * | 1/1975 | Selliken | 473/501 |
| 4,160,324 | A | * | 7/1979 | Dunn | 33/759 |
| 4,266,768 | A | | 5/1981 | Hall | |
| 4,398,715 | A | | 8/1983 | Hall | |
| 4,531,733 | A | | 7/1985 | Hall | |
| 4,542,901 | A | * | 9/1985 | Fatool et al. | 473/501 |
| 4,634,120 | A | | 1/1987 | Hall | |
| 4,744,561 | A | | 5/1988 | Hall | |
| 4,979,740 | A | | 12/1990 | Hall | |
| 5,415,394 | A | | 5/1995 | Hall | |
| 5,556,089 | A | | 9/1996 | Hall | |
| 5,564,695 | A | * | 10/1996 | Christensen | 473/501 |
| 5,590,874 | A | | 1/1997 | Hall | |
| 5,601,900 | A | * | 2/1997 | Doscher | 428/149 |
| 5,772,539 | A | | 6/1998 | Hall | |
| 6,077,175 | A | * | 6/2000 | Fearnow | 473/468 |
| D477,171 | S | * | 7/2003 | Gabbour | D6/582 |

* cited by examiner

*Primary Examiner*—Mitra Aryanpour
(74) *Attorney, Agent, or Firm*—Polster Lieder Woodruff & Lucchesi, LC

(57) ABSTRACT

A base for baseball or softball including a bottom surface wherein at least a portion of the bottom surface includes a prepared surface having a higher coefficient of friction than the surface in its unprepared state and wherein the base will move from its resting position when a human body applies a lateral force thereto, the force being low enough to avoid substantial injury to the human body, but will remain in position when a force applied to the base includes a downward force component that is substantial in comparison to the lateral force component.

19 Claims, 6 Drawing Sheets

BASES FOR BASEBALL AND SOFTBALL

FIELD OF THE INVENTION

The invention relates to baseball and softball. More specifically, the invention relates to improved bases for the games of softball and baseball.

BACKGROUND OF THE INVENTION

In the United States, the games of softball and baseball are very popular. Moreover, softball and baseball enjoy great popularity in many East Asian, Latin American and Caribbean countries, as well. In a 2006 Gallup poll of Americans, 49% considered themselves baseball fans. In 2006, almost 2.3 million children played Little League Baseball worldwide, which is the largest of several leagues that organize youth baseball for children 5-18 years old. In the United States, most high schools and colleges provide baseball and softball as an intramural or competitive extra-curricular activity. In the United States, while on par in popularity with football, baseball is the oldest major sport and holds the most exalted position as the American pastime.

Familiarity with the basic concepts of the rules of baseball and softball are assumed, as one of ordinary skill in the art would know the rules intimately. However, the rules of baseball and softball provide for markers known as bases that are positioned at the four corners of a diamond, up to 90 feet in distance depending upon the age level of the players or whether baseball of softball is being played. Three of the bases are commonly referred to as bags, because they are short boxes that are placed on the surface of the ground and rise up one to four inches in height. The fourth base, known as home plate, is much thinner and rises above the ground less than one inch. Also, a pitching rubber is placed on a pitcher's mound from which the ball is thrown.

These bases are commonly held in position one of three ways. Major league teams and other organized baseball leagues generally use hollow, square metal posts located in the ground at the proper base locations. Stanchions that are attached to the bottom of the bases are placed in the hollow posts. In this manner, the bases are firmly and fixedly, yet removably positioned for play. Runners running to the bases do not have to fear that the bases will slide as the runner slides into or steps on the base. However, this method requires digging a hole into the ground and repacking the dirt around the post. This can be accomplished on a dedicated baseball field, but it is very difficult and time consuming when bases are arranged on an impromptu baseball field, such as is common for practices, for young children or for a number of other situations where a dedicated field is not used, such as indoors.

The second common type of base uses spikes that are driven into the ground that are attached to straps. The straps are cinched tight to the base and the spikes that hold the base in position. These types of bases are undesirable because they require driving a spike into the ground, which is not possible when playing indoors or on an asphalt or concrete surface, because they require tools for installation and because the bases come in multiple parts, which inevitably become lost.

A third type of base commonly used are "throwdown bases." These bases typically are formed from a single piece or molded rubber or vinyl. These bases are generally thinner than official bases. These bases also suffer from sliding and slipping particularly on grassy or wet surfaces.

As a result of the undesirability of these methods, softball and baseball bases are frequently positioned without any anchoring of any type. For bases, this is undesirable because runners running across or sliding to a bag will move the bag inadvertently. This is undesirable because the player may slip and fall thereby causing as injury or the base may be moved from its required position according the rules of baseball or softball.

Moreover, youth baseball leagues have recently mandated bases that, when a player slides into the base, "breaks away" from its position so that the runner is not injured, as commonly occurs with bases that are rigidly held in place, as described above. Put another way, leagues are requiring a base that will move when a lateral load is applied. The difficulty is designing such a base that will not move when the runner merely runs across the base, i.e. when the load applied is a combination of a lateral load and a vertical load.

Others have attempted to create a base that satisfies these requirements. For example, U.S. Pat. No. 4,266,768 to Roger Hall discloses a base with a "breakaway element," such as a hook and loop material attached to a base and a receiver portion that is buried in the ground. However, this attempt still requires buried elements and is not tolerant of dirty conditions, which are common on a baseball field. For other reasons, this design has not gained widespread success. The same inventor has patented other similar designs, which all require buried elements or elaborate designs.

Therefore, there is a need in the art for baseball and softball bases that do not require the digging of a hole, driving of a stake, tools or detachable parts in order to be securely and firmly and removably mounted in position.

SUMMARY OF THE INVENTION

A base for baseball or softball comprising a bottom surface wherein at least a portion of the bottom surface comprises a prepared surface having a higher coefficient of friction than the surface in its unprepared state and wherein the base will move from its resting position when a human body applies a lateral force thereto, the force being low enough to avoid substantial injury to the human body, but will remain in position when a force applied to the base comprises a downward force component that is substantial in comparison to the lateral force component.

DESCRIPTION OF THE PREFERRED EMBODIMENT

Figure 1:
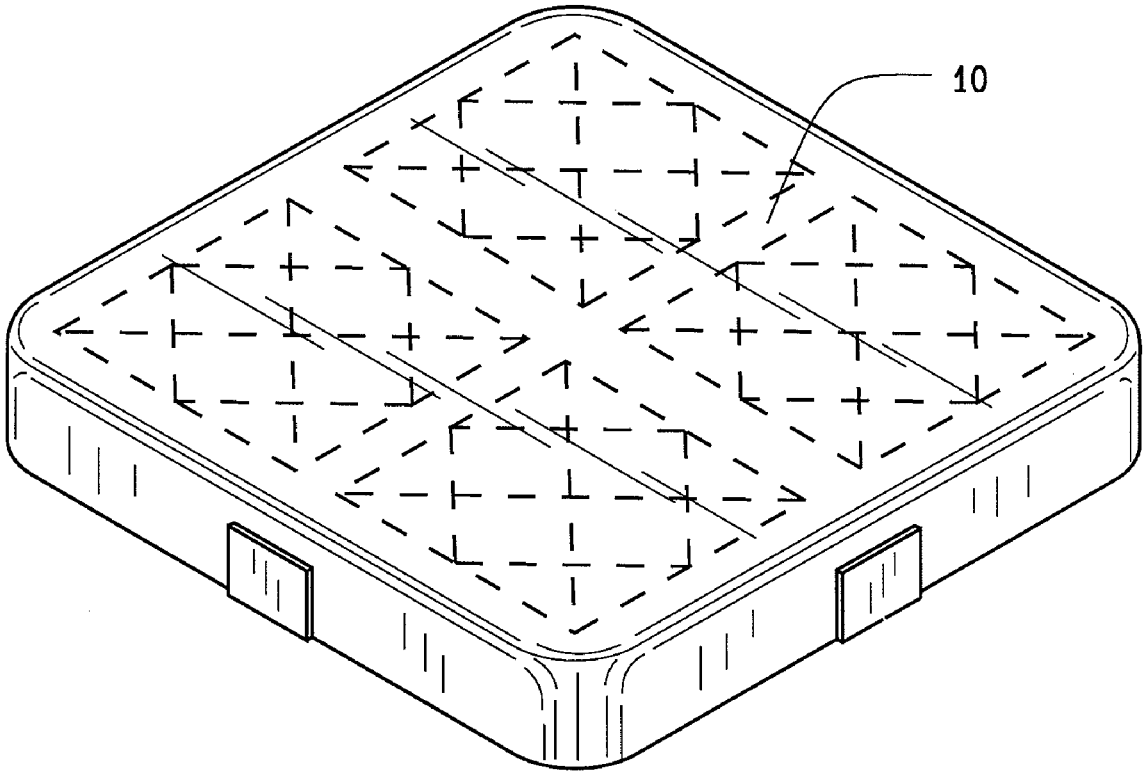
FIG. 1 is a top perspective view of a base according to an embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
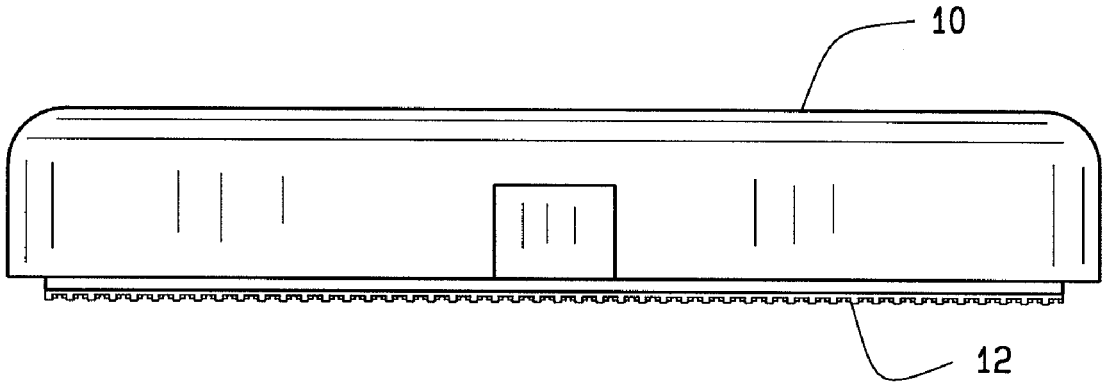
FIG. 2 is a side view of a base according to an embodiment of the present invention.
Figure 3:
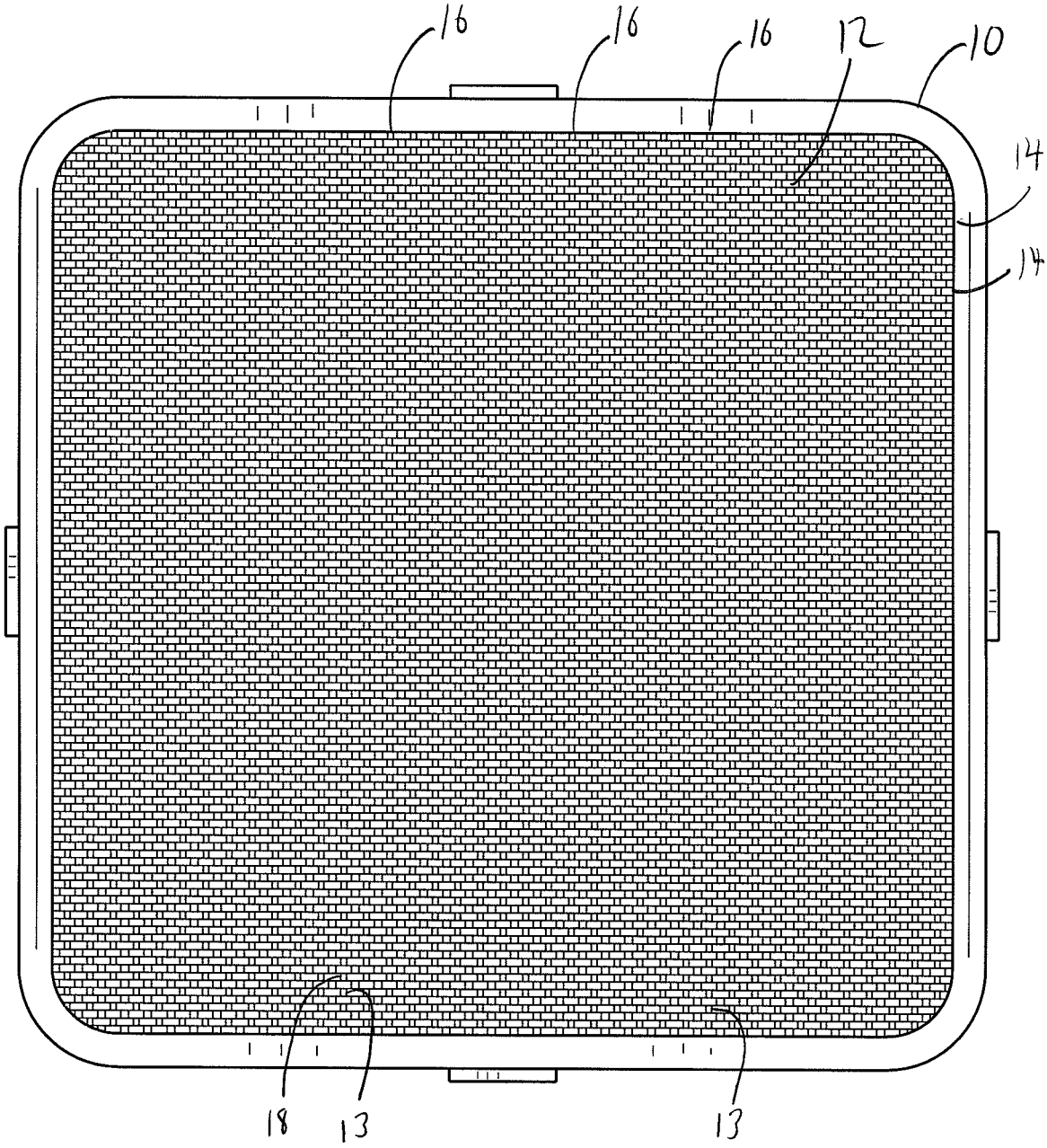
FIG. 3 is a bottom view of a base according to an embodiment of the present invention.

Referring to FIGS. 1 and 2, the preferred embodiment of the present invention comprises a base 10 for baseball or softball having a high friction, non-slip prepared surface 12 applied thereto or molded thereon. The base 10 may comprise a standard base having a fabric exterior surface and a resilient foam interior filling or comprise a base of any other known or later developed construction. The prepared surface 12 is prepared to increase the coefficient of friction between the base and the surface upon which it is placed without causing any type of interlocking of the base to the surface that would require an upwardly directed component of force to move the bag from its resting position. This is accomplished in one of many ways. In one way, the base is made from a material that has a higher coefficient of friction. In another way, the surface is manipulated such that it has a higher coefficient of friction than if the surface were flat or smooth, for example, the bottom of the base comprises a roughened surface comprising a regular or irregular mesh or weave surface. The mesh or weave may comprise a plurality of nodules 13 that extend outwardly. In a preferred embodiment, the prepared surface 12 is a textured surface having thousands of nodules when the surface 12 covers the entire bottom surface of the base 10. In the very most preferred embodiment, the prepared surface preferably comprises an SBR rubber material commonly used in the construction of conveyor belts.

The nodules 13 are preferably arranged in rows 14 having troughs 16 therebetween. The extension of the nodules 13 from the troughs 16 are about 3/32" in the most preferred embodiment. Attached to either side of the nodules 13 are webs 18 extending between adjacent nodules 13 which protrude above the troughs 16 but not at the same height as the nodules 13. The webs 18 preferably extend about 3/64" from the troughs 16.

The prepared surface 12 can be obtained from HBD Thermoid, Inc. as conveyor belting under the trademark GRIPTOP or from Chemprene, Inc. under part no. 66(18-1)3(15).

While it is preferred that the prepared surface 12 extend over the entire bottom surface of the base, it is within the scope of the invention to include the prepared surface 12 on only portions of the bottom surface, such as in the center or near the four corners of the base. The coverage of the nodules across the bottom of the base will vary depending upon the amount of lateral force that the base will accept before moving from its position. It may be desired to apply more or less coverage if the base is intended for use on different surfaces or with different age groups. For example, bases intended for very small children may have less coverage due to the lighter weight of the players. Bases intended for adults may have more coverage due to the heavier players.

Figure 6:
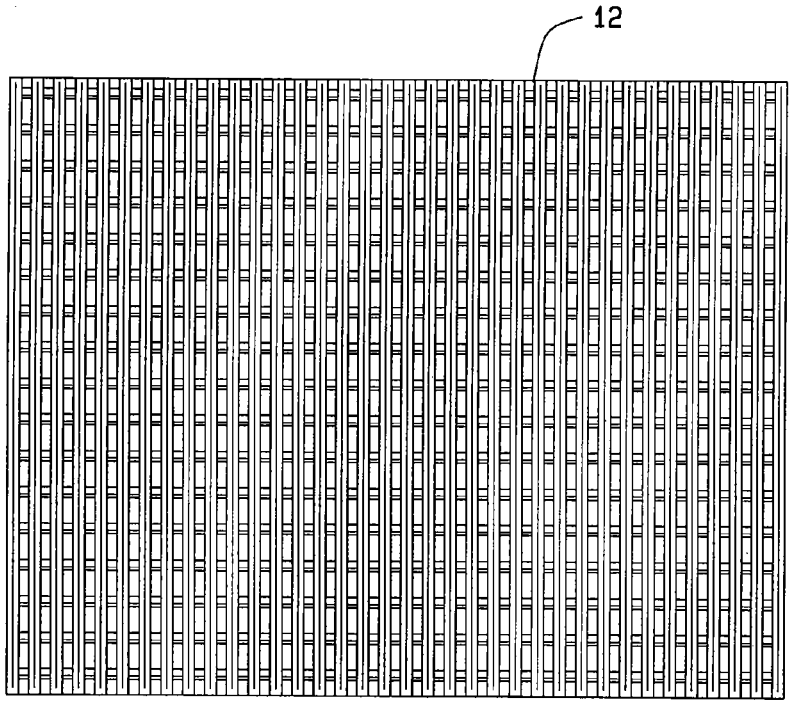
FIG. 6 is a close-up photograph of a base according to a preferred embodiment of the present invention.
Figure 7:
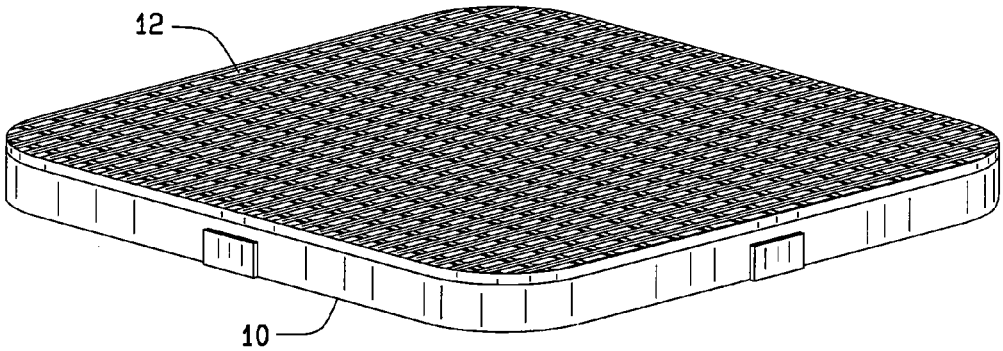
FIG. 7 is a perspective photograph of a base according to a preferred embodiment of the present invention.

One detailed embodiment of the prepared surface 12 of the base 10, as described above, is shown in FIGS. 6 and 7. However, this embodiment is merely provided as an illustrative embodiment and to provide the most information to the reader as to aspects of the most preferred embodiment invention. It is not intended to be limiting of the invention or the claims. FIGS. 6 and 7 show the prepared surface 12 comprising vertical rows or ribs and horizontal rows or ribs that protrude less than the vertical ribs.

Figure 4:
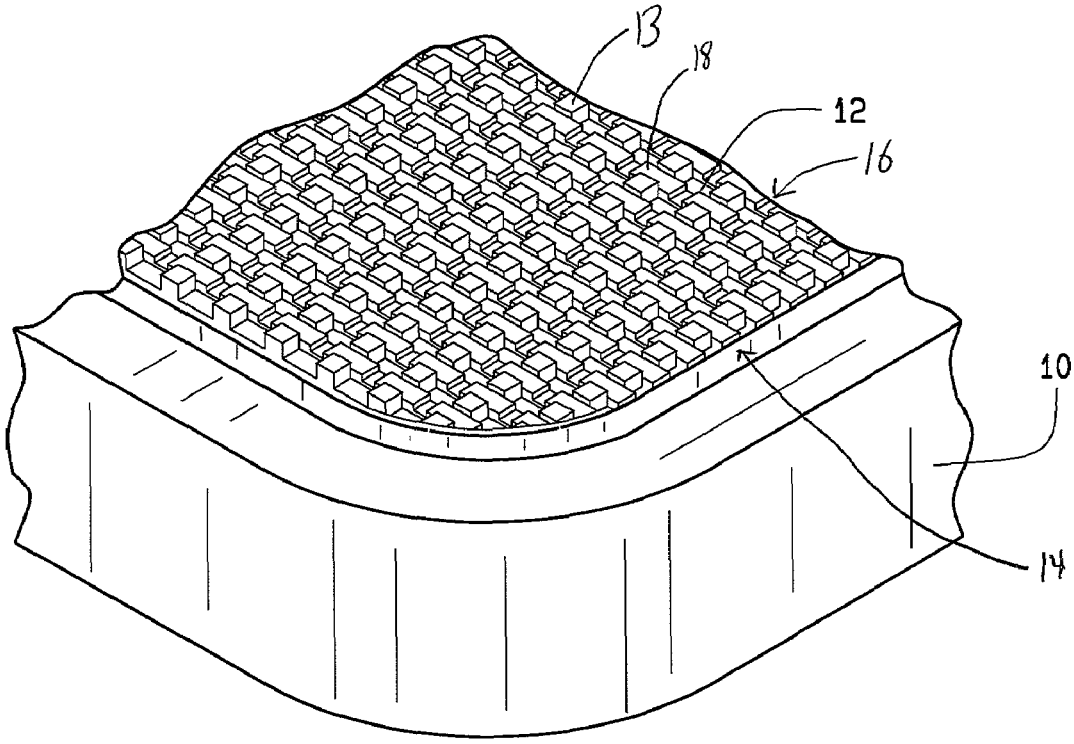
FIG. 4 is a close-up of a bottom view of a base according to an embodiment of the present invention.
Figure 5:
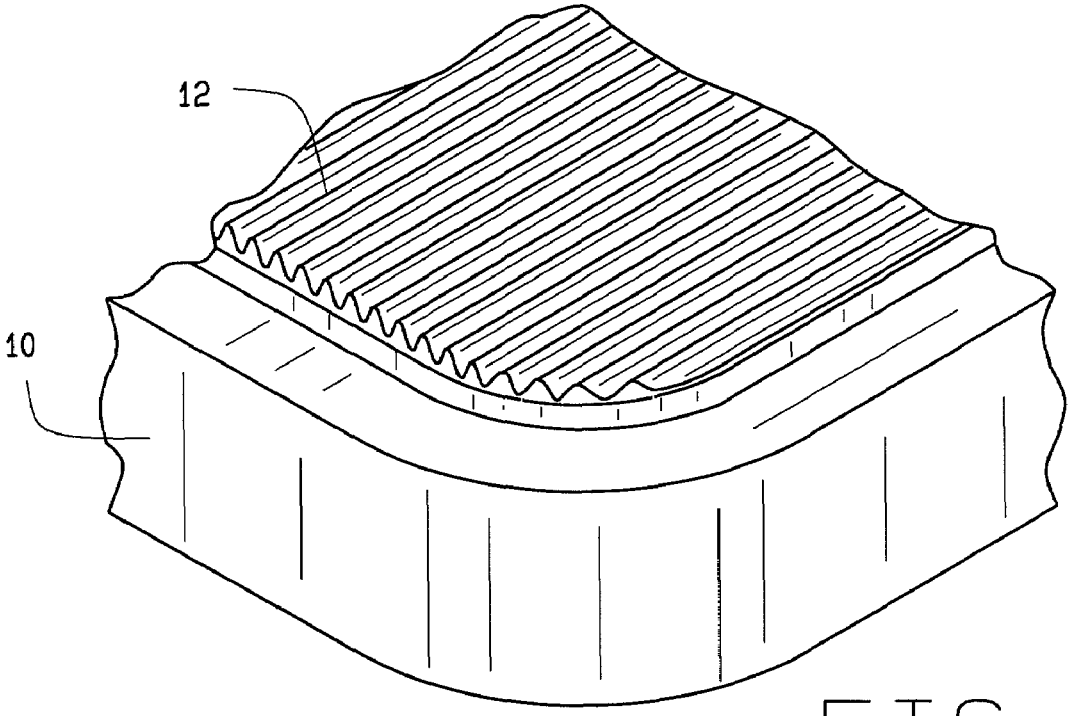
FIG. 5 is a bottom view of a base according to a second embodiment of the present invention.
Figure 8:
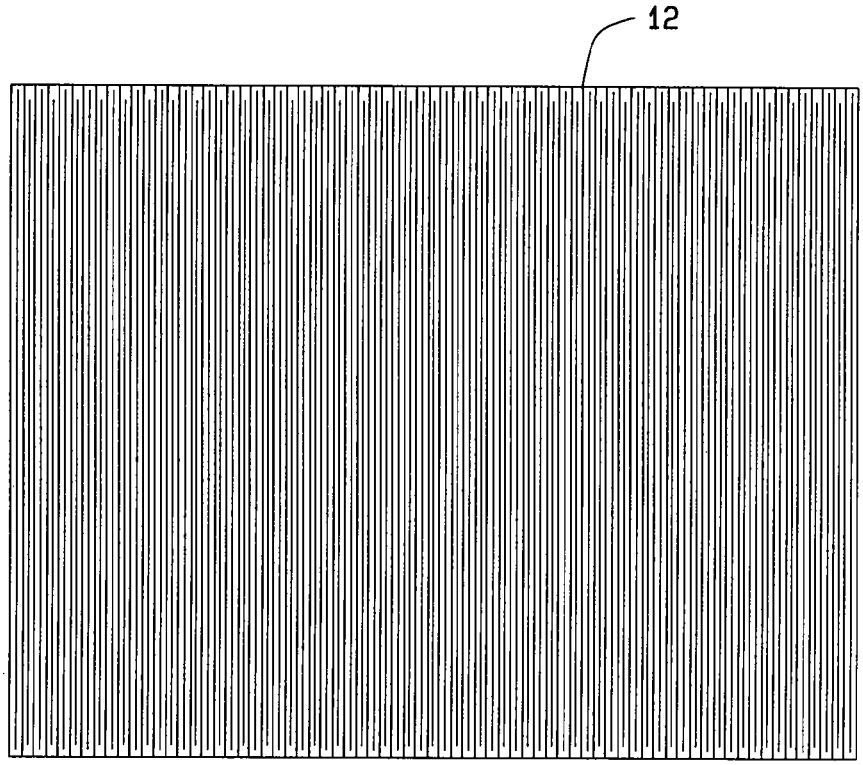
FIG. 8 is a close-up photograph of a base according to a second preferred embodiment of the present invention.

In a second embodiment and referring to FIG. 4, the prepared surface 12 comprises a textured surface having only laterally running grooves of a width of about 1/64" and a depth of 1/32". The material is a pure gum rubber material for maximum adhesion and is available from Chemprene, Inc. under part no. 3682(24)37A-0. The embodiment is most preferred for pitching rubbers. A particularly detailed embodiment, which is not intended to limit to the invention but merely provided for the benefit of the reader, is shown in FIG. 8. In FIG. 8, the prepared surface comprises a plurality of ribs running in only a single direction across the base.

While it is most beneficial to provide the bases shown without buried elements, sometimes it is beneficial to include a buried element or marker 22 so that the player will know the proper location of the base if the base has been moved from its proper location as a result of a large lateral force (a "break away force"). This buried element 22 may comprise a buried post and stanchion 24 as in the prior art except attached to the stanchion 24 is a flat surface or base portion 26 that is placed just below ground level. Alternatively, the base portion 26 could be attached to the ground by other methods. The flat surface 26 indicates to the base runner and to officials the proper location of the base after the base has been moved so that the runner will know the proper location of the base. For example, in an instance where the runner has slid into the base and moves the base but gets up to proceed to the next base (for example if there has been an error, the next runner (or the same runner) will know the proper location of the base, due to the fixed location of the marker 22, and use the location of the marker 22 to continue play. Moreover, the marker 22 will indicate to officials the proper location of the base so it can be replaced after play has stopped and time has been called.

The marker 22 may simply comprise a piece of steel or plastic and may be smooth or textured to hold the base in position. Moreover, a fabric 28 may be adhered to the marker 22, such as a false grass material such as ASTROTURF, so that the marker 22 has a soft texture. However, the marker 22 need not interlock with the base and merely provides a resting platform for the base.

It has been discovered that the above configurations provide the greatest flexibility for surfaces of different types, such as prepared dirt, dry grass, wet grass, hard surfaces such as asphalt and concrete and wood flooring, such as used in gymnasiums. The prepared surfaces provide much better adhesion of the base to the ground without slippage of the base from vertical loads while allowing movement of the base for purely lateral loads.

While the above embodiments have been described with respect to bases, i.e. first base, second base and third base, all of the described elements work equally for pitching rubbers and home plate. In the claims, the term "base" shall be construed so as to include home plate and a pitcher's rubber.

Figure 9:
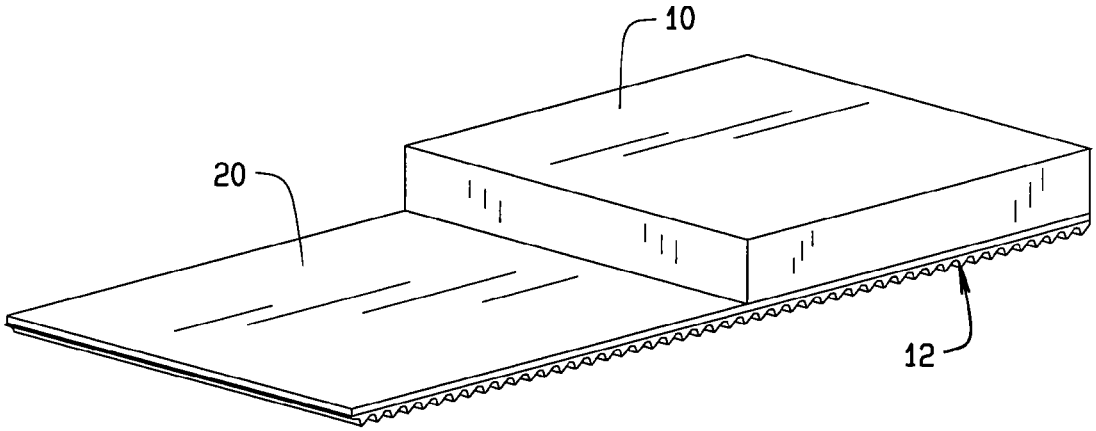
FIG. 9 is a top perspective view of a pitching rubber according to a preferred embodiment of the present invention.
Figure 10:
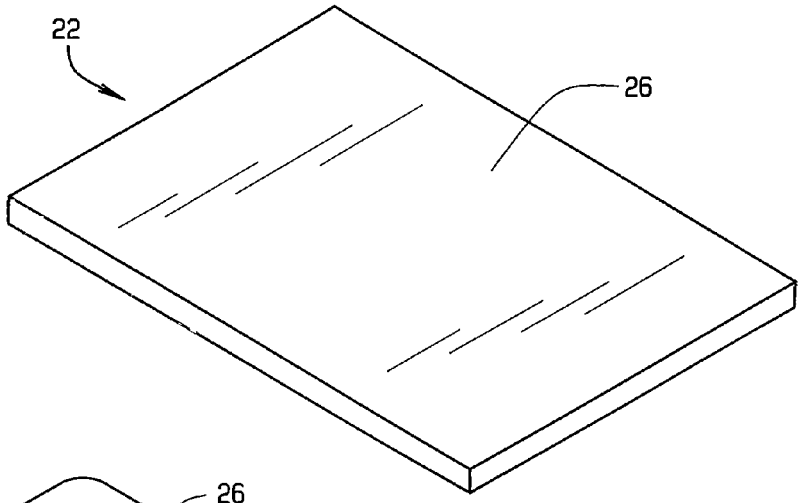
FIG. 10 is a top perspective view of a marker, having a smooth top surface, placed below a base according to an embodiment of the present invention.
Figure 11:
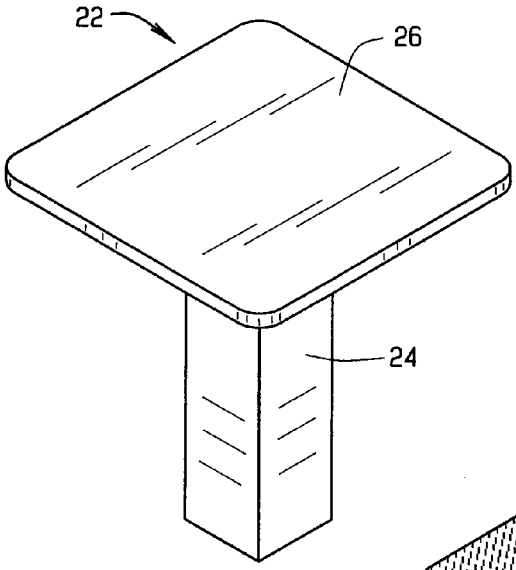
FIG. 11 is a top perspective view of a marker, having a smooth top surface, placed below a base and including a buried element according to an embodiment of the present invention.
Figure 12:
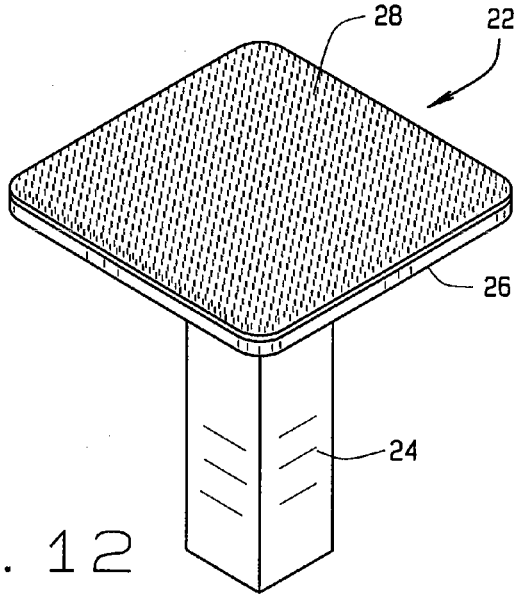
FIG. 12 is a top perspective view of a marker, having a textured top surface, placed below a base and including a buried element according to an embodiment of the present invention.

Due to the small size of a pitching rubber, in another embodiment of the invention, it has been found to be advantageous to provide a support base 20 having a prepared surface 12 for a pitching rubber 10 that is larger in size than a standard pitching rubber. As shown in FIG. 9, a pitching rubber 10 having the enlarged support base 20 is provided. The enlarged support base 20 allows the pitching rubber 10 to stay in position as the pitcher pushes off of the rubber because his weight transfers from the rubber 10 to the base 20. This increased stability of the pitching rubber 10 allows the pitching rubber 10 to stay in position when the pitcher applies a high lateral load to the rubber. This is advantageous because runners do not slide into pitching rubbers and therefore the "break away" aspect is not important, and actually undesirable, for a pitching rubber. On the contrary, pitchers regularly apply high lateral loads to the pitching rubber when pitching and preventing movement under these loads is important. Therefore, unlike bases, it is desirable for the pitching rubber to not move when high lateral loads are applied and the illustrated improved pitching rubber accomplishes this goal.

The above examples show that the invention, as defined by the claims, has far ranging application and should not be limited merely to the embodiments shown and described in detail. Instead, the invention should be limited only to the explicit words of the claims, and the claims should not be limited to the detailed embodiments shown in the specification, which represent the best modes of the invention and not the extents of protection. The scope of protection is only limited by the scope of the accompanying claims, and the Examiner should examine the claims on that basis.

I claim:

1. A base apparatus comprising:

a base configured for playing baseball or softball, the base including a bottom surface wherein at least a portion of the bottom surface comprises a prepared surface having a higher coefficient of friction than the surface in its unprepared state and wherein the base will move from its resting position when a human body applies a lateral force thereto, the force being low enough to avoid substantial injury to the human body, but will remain in position when a force applied to the base comprises a downward force component that is substantial in comparison to the lateral force component, the prepared surface being formed directly on the bottom of the base, wherein the prepared surface comprises a plurality of raised nodules and a plurality of raised webs, the plurality of raised nodules and the plurality of raised webs each extending from the prepared surface, the plurality of raised nodules extending beyond the plurality of raised webs, and each of the plurality of raised nodules disposed directly adjacent to each of the plurality of raised webs.

2. The base apparatus of claim 1 wherein the nodules and the webs are regularly spaced.

3. The base apparatus of claim 1 wherein the base does not interlock with the surface upon which it is placed.

4. A base set comprising:

a base configured for playing baseball or softball comprising a bottom surface wherein at least a portion of the bottom surface comprises a prepared surface having a higher coefficient of friction than the surface in its unprepared state and wherein the base will move from its resting position when a human body applies a lateral force thereto, the force being low enough to avoid substantial injury to the human body, but will remain in position when a force applied to the base comprises a downward force component that is substantial in comparison to the lateral force component, the prepared surface being formed directly on the bottom of the base;

a marker portion placed below the prepared surface; and the marker portion being adapted such that when the base is placed upon the marker portion during game play, the marker portion is substantially covered by the base, the marker portion adapted to remain in a fixed position when the base is moved from its resting position during game play to indicate the previous location of a dislodged base such that an official can determine whether players have properly tagged the marker portion.

5. The base set of claim 4 wherein the marker portion is anchored to the ground.

6. The base set of claim 5 wherein the marker portion is anchored to the ground by inserting a stanchion attached to the marker portion into a receiver that is buried in the ground.

7. The base set of claim 4 wherein marker portion comprises a roughen surface for contacting the prepared surface.

8. The base set of claim 4 wherein the marker portion comprises a fabric.

9. The base set of claim 8 wherein the fabric is a false grass material.

10. The base set of claim 4 wherein the prepared surface comprises a plurality of raised nodules and a plurality of raised webs, the plurality of raised nodules and the plurality of raised webs each extending from the prepared surface, the plurality of raised nodules extending beyond the plurality of raised webs.

11. The base set of claim 4 wherein the base does not interlock with the surface upon which it is placed.

12. A base set comprising:

a base configured for playing baseball or softball;

the base comprising a bottom surface wherein at least a portion of the bottom surface comprises a surface that has a coefficient of friction sufficient to allow the base to move from its resting position when a human body applies a lateral force thereto, the force being low enough to avoid substantial injury to the human body, but will remain in position when a force is applied to the base comprising a downward force component that is substantial in comparison to the lateral force component and wherein the base requires generally no upwardly force component to cause the base to move laterally when the lateral force is applied, the bottom surface being formed directly and integrally with the bottom of the base;

a marker portion placed below the bottom surface; and the marker portion being adapted such that when the base is placed upon the marker portion during game play, the marker portion is substantially covered by the base, the marker portion adapted to remain in a fixed position when the base is moved from its resting position during game play to indicate the previous location of a dislodged base such that an official can determine whether players have properly tagged the marker portion.

13. The base set of claim 12 wherein the bottom surface comprises a plurality of raised nodules and a plurality of raised webs, the plurality of raised nodules and the plurality of raised webs each extending from the prepared surface, the plurality of raised nodules extending beyond the plurality of raised webs.

14. The base set of claim 12 wherein the base does not interlock with the surface upon which it is placed.

15. The base set of claim 12 wherein the marker portion is anchored to the ground.

16. The base set of claim 15 wherein the marker portion is anchored to the ground by inserting a stanchion attached to the marker portion into a receiver that is buried in the ground.

17. The base set of claim 12 wherein marker portion comprises a roughen surface for contacting the bottom surface.

18. The base set of claim 12 wherein the marker portion comprises a fabric.

19. The base set of claim 18 wherein the fabric is a false grass material.

* * * * *

US007717813C1

(12) INTER PARTES REEXAMINATION CERTIFICATE (0250th)

United States Patent

Sinovich

(10) Number: US 7,717,813 C1

(45) Certificate Issued: Mar. 15, 2011

(54) BASES FOR BASEBALL AND SOFTBALL

(76) Inventor: Marc F. Sinovich, Maryland Heights, MO (US)

Reexamination Request:
No. 95/000,555, Jul. 13, 2010

Reexamination Certificate for:

| | |
|---|---|
| Patent No.: | **7,717,813** |
| Issued: | **May 18, 2010** |
| Appl. No.: | **11/557,558** |
| Filed: | **Nov. 8, 2006** |

(51) Int. Cl.

| | |
|---|---|
| ***A63B 71/00*** | (2006.01) |
| ***A63B 69/00*** | (2006.01) |

(52) U.S. Cl. ..... 473/499; 473/452

(58) Field of Classification Search ..... None

See application file for complete search history.

(56) References Cited

U.S. PATENT DOCUMENTS

| | | | |
|---|---|---|---|
| 4,266,768 | A | 5/1981 | Hall |
| 4,531,733 | A | 7/1985 | Hall |

FOREIGN PATENT DOCUMENTS

| | | |
|---|---|---|
| CA | 1 250 330 | 2/1989 |
| CA | 2034748 | 9/1991 |
| CA | 2092611 | 9/1994 |

*Primary Examiner*—Catherine S. Williams

(57) ABSTRACT

A base for baseball or softball including a bottom surface wherein at least a portion of the bottom surface includes a prepared surface having a higher coefficient of friction than the surface in its unprepared state and wherein the base will move from its resting position when a human body applies a lateral force thereto, the force being low enough to avoid substantial injury to the human body, but will remain in position when a force applied to the base includes a downward force component that is substantial in comparison to the lateral force component.

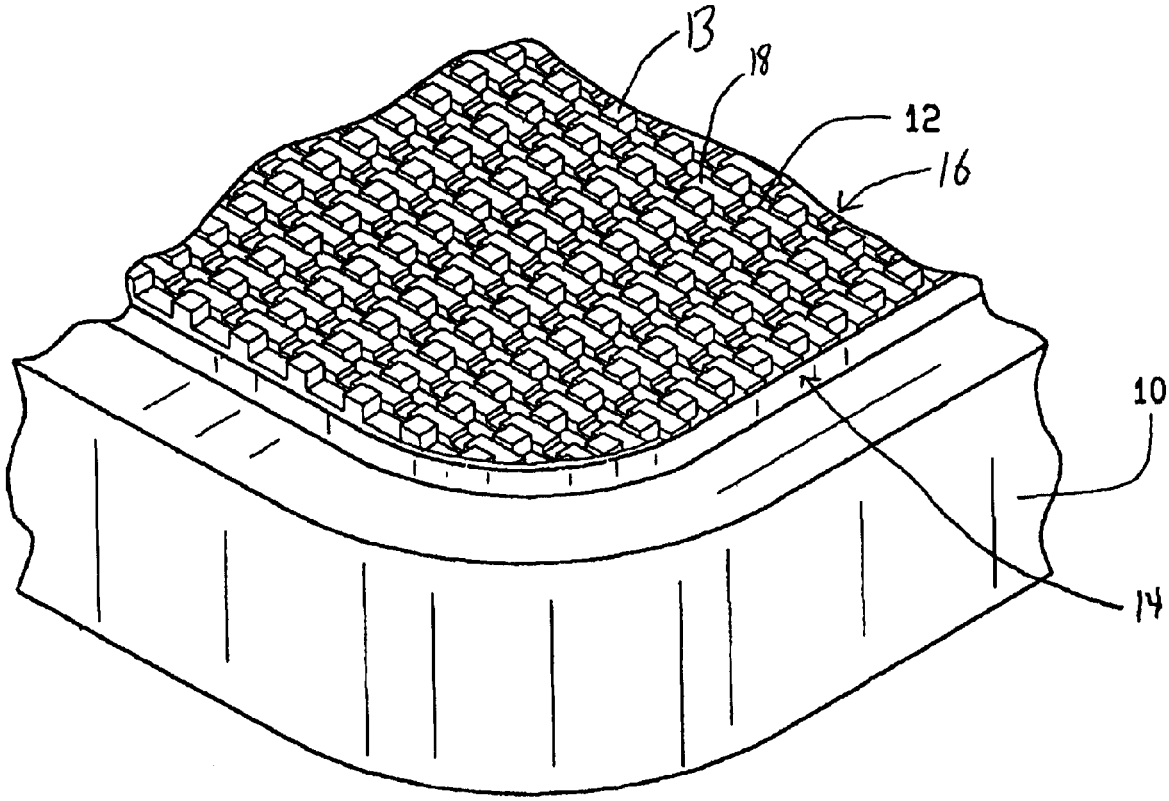

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1, 2, 4-8 and 10-18 are cancelled.

Claims 3, 9 and 19 were not reexamined.

* * * * *